United States Patent [19]

Dudley et al.

[11] Patent Number: 4,504,425

[45] **Date of Patent: * Mar. 12, 1985**

[54] PROCESS AND APPARATUS FOR EFFECTING CARBURETION

[75] Inventors: Darnell T. Dudley, East Lansing; Herman F. Luhrs, Rapid City, both of Mich.

[73] Assignee: Dynamic Technological Developments, Inc., East Lansing, Mich.

[ * ] Notice: The portion of the term of this patent subsequent to Jan. 12, 2000 has been disclaimed.

[21] Appl. No.: 163,180

[22] Filed: Jun. 26, 1980

[51] Int. Cl.[3] ..... F02M 7/22

[52] U.S. Cl. ..... 261/50 A; 261/79 R

[58] Field of Search ..... 261/50 A, 79 R

[56] References Cited

U.S. PATENT DOCUMENTS

| | | | |
|---|---|---|---|
| 1,207,224 | 12/1916 | Schlayer | 261/79 R |
| 1,285,329 | 11/1918 | Newsom | 261/79 R |
| 1,801,702 | 4/1931 | Wasley | 261/79 R |
| 1,867,742 | 7/1932 | Hawley | 261/79 R |
| 1,925,583 | 9/1933 | Delplanque | 261/DIG. 39 |
| 2,011,997 | 8/1935 | Cameron | 261/79 R |
| 2,016,086 | 10/1935 | Fisher | 261/79 A |
| 2,118,038 | 5/1938 | Brodersen et al. | 261/48 |
| 2,529,665 | 11/1950 | Russell | 261/50 A |
| 2,536,700 | 1/1951 | Russell | 261/79 R |
| 3,332,231 | 7/1967 | Walsh | 261/79 R |
| 3,336,017 | 8/1967 | Kopa | 261/79 R |
| 3,519,407 | 7/1970 | Hilborn | 261/DIG. 39 |

FOREIGN PATENT DOCUMENTS

| | | | |
|---|---|---|---|
| 524052 | 4/1955 | Italy | 261/79 R |

OTHER PUBLICATIONS

Caldwell, Spray Discharge Equalizer, Scientific American, p. 582, Jun. 9, 1917.

*Primary Examiner*—Tim R. Miles

*Attorney, Agent, or Firm*—Gordon W. Hueschen

[57] ABSTRACT

The disclosure relates to a process and apparatus for effecting carburetion to provide an air and vaporized fuel mixture for operating an internal combustion engine, or the like. A vaporizing and mixing chamber is justaposed on an intermediate chamber which, in turn, is justaposed on a holding chamber. Ambient air is admitted to the intermediate chamber and fuel at ambient pressure is admitted to the holding chamber. Metering means is provided for metering air flow from the intermediate chamber into the vaporizing and mixing chamber and for metering the flow of liquid from the holding chamber. The fuel flows axially to a jet orifice into the confluence of a plurality of air jet passages directed counter to the flow of fuel to the jet orifice and the resultant mixture of air and liquid fuel is aspirated in a column into the vaporizing and mixing zone. A whirling motion is imparted to the air-liquid fuel mixture in the column so that, when it reaches the vaporizing and mixing column, it flies out by centrifugal force into the vaporizing and mixing chamber. The air jet orifices are directed at an acute, oblique angle, so that the jet orifices are an annular loci at the base of the column and the fuel is jetted up into the center of the loci. A turbulent vortex is thus established at the confluence which promotes disintegration of the fuel into tiny globules and dispersion of these globules into the air.

34 Claims, 13 Drawing Figures

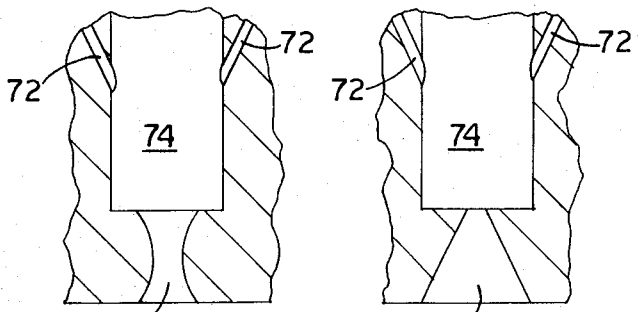
FIG. 10
FIG. 11
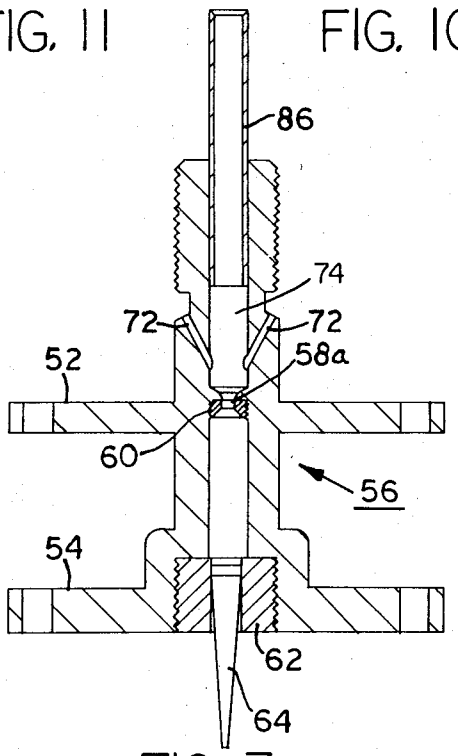
FIG. 3
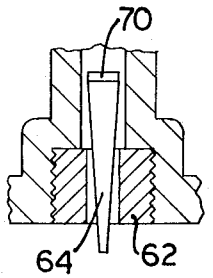
FIG. 4
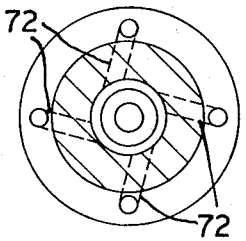
FIG. 8
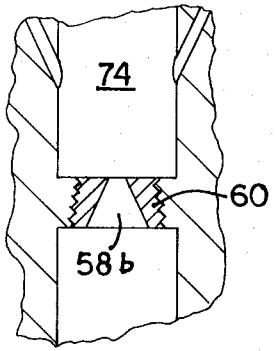
FIG. 9
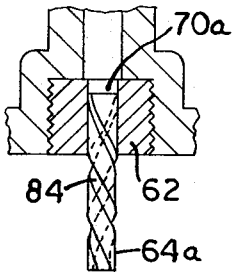
FIG. 5
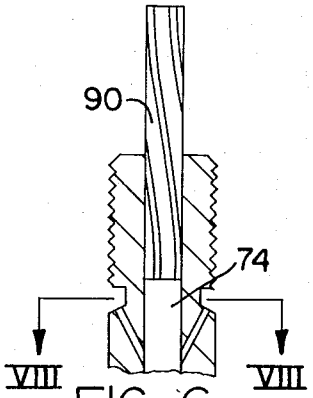
FIG. 6
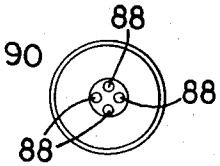
FIG. 7
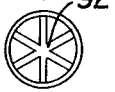
FIG. 12
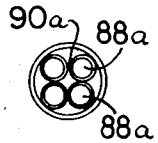
FIG. 13

PROCESS AND APPARATUS FOR EFFECTING CARBURETION

FIELD OF INVENTION AND PRIOR ART

The invention relates to a process and apparatus for effecting carburetion of a gaseous component and a volatile liquid component of a reaction mixture which needs to be in a gaseous condition prior to the initiation of the reaction.

Up-draft carburetors have the advantage that floats and needle valves may be dispensed with so that they are relatively insensitive to the presence of dirt in the fuel vaporized in the carburetor. Typical of such up-draft carburetors is the one illustrated in U.S. Pat. No. 2,529,665, issued Nov. 14, 1950. Such carburetors aspirate air and a mixture of air and fuel into a mixing and vaporizing chamber and are dependent on their successful operation on effective mixing of the fuel and air aspirated as a mixture into the vaporizing and mixing chamber.

In the up-draft carburetors of the prior art, however, for example, the one cited above, adequate mixing of the fuel and air in the mixture aspirated into the mixing and vaporizing zone has not been adequate to produce a uniform distribution of air and fuel molecules into the intake of the cumbustion engine.

OBJECTS OF THE INVENTION

It is an object of the invention to provide an improved process for effecting carburetion. It is a further object of the invention to provide an improved apparatus for effecting carburetion. It is a further object of the invention to provide such a process and apparatus in which effective and efficient mixing of fuel and air in the mixture fed to the mixing and vaporizing chamber is obtained. It is a further object of the invention to obtain a very uniform dispersion of very fine droplets of fuel in the air-fuel mixture vaporized in the mixing chamber where a uniform distribution of air and fuel molecules is delivered to the intake. It is a further object of the invention to accomplish these results solely by the aspirating effect of the subambient pressure induced in the vaporizing and mixing chamber as a result of the operation of the engine and to accomplish the same in a simple and effective manner.

Further objects of the invention are to avoid the disadvantages of the prior art and to obtain such advantages as will appear as the description proceeds.

BRIEF DESCRIPTION OF THE INVENTION

The invention relates to improvements in a process and apparatus for effecting carburetion of a gaseous component and a volatile liquid component of a reaction mixture which needs to be in a gaseous condition prior to the initiation of the reaction, in which a portion of the gaseous component is aspirated into a vaporizing and mixing column or chamber which, in the operation of the reaction, is maintained at subambient pressure; feeding the remaining portion of the gaseous component with the liquid component in such a manner that the liquid component is dispersed in the liquid phase in the gaseous component; and aspirating the resultant mixture into the vaporizing chamber or column and allowing it to disperse therein; which improvement comprises effecting the mixing by aspirating a jet of the liquid component along the axis of said vaporizing and mixing column; aspirating a plurality of jets of gaseous component at an acute angle to the flow of liquid along said axis to a confluence with the jet of liquid component; and imparting to the resulting mixture, as it continues along said axis to said vaporizing and mixing column, a columnated, whirling motion of diameter substantially less than that of the vaporizing and mixing column so that the resultant mixture flies out radially as a result of centrifigual force when it reaches the vaporizing and mixing chamber, thereby creating a turbulence which promotes mixing and vaporization therein.

In accordance with one form of the invention, the whirling motion imparted to the resultant mixture is effected by imparting a whirling motion thereto at the confluence. Advantageously, the whirling motion at the confluence comprises a circumferential component and a radial component which combine to form a turbulent vortex into the eye of which the liquid component is aspirated. Advantageously, this turbulent vortex is effected by aspirating a plurality of jets of gaseous component at an acute, oblique angle to an annular loci at the base of the whirling column of resultant mixture and aspirating the jet of liquid component into the center of said annular loci.

It is to be understood that an acute, oblique angle, as the term is used herein, refers to one in which the projection onto a axial plane forms an acute angle, whereas, the projection onto a transverse plane shows a projection which is canted or oblique, which reference to the axial plane.

An acute, oblique angle with the ends of the jets terminating in an annular loci impart to the confluence a vertical component which causes the gaseous component to roll in a torus-like manner and a horizontal component, which impresses thereon, causes a circumferential motion. By choice of proper acute angles, the radial roll will tend to be across the top of the torus and down, so that the flow is counter to the flow of the jet which comes up through the eye of the vortex. At the same time, a whirling or swirling motion is imparted by the transverse component of the jets of gaseous component. As a consequence, the liquid component is aspirated into the eye of the high turbulent vortex where it is broken down into fine globules and dispersed uniformly in the gaseous component and the resultant mixture is aspirated downstream in a columnated, whirling motion of relatively small diameter, compared with the diameter of the vaporizing and mixing chamber, so that, when the whirling mixture reaches the top of the column, it flies out radially as a result of centrifugal force into the vaporizing and mixing column, thereby creating a turbulence which promotes vaporizing and complete mixing of the molecules of the liquid and gaseous components.

Advantageously, the whirling motion in the whirling column of the resultant mixture is effected in a portion of the column above that where the vortex is established and, advantageously, in a direction which is counter to that of the circumferential component of the vortex. This effects an abrupt reversal of flow creating a shear action which further breaks up the globules of liquid component and still more completely disperses them in the gaseous component.

It is sometimes of advantage, also, to effect a whirling motion in the jet of liquid component before it reaches the vortex. Advantageously, this is also counter to the motion in the vortex, so that still better breaking up of the globules of the liquid component and dispersing them in the gaseous component is obtained. The optimum is obtained when the fuel jet whirls in one direction, the vortex in the opposite direction, and the whirling column in a direction opposite to the vortex. It is to be understood, however, that the whirling motions can be all in the same direction, or, some in one direction and others in another direction. It is also to be understood that in the broader aspects of the invention any one of the whirling motions can be used without the others. Thus, in the broader aspect of the invention, the mixing of the liquid component and the gaseous component can be effected as in the prior art, without forming a turbulent vortex, and the whirling motion imparted thereto by suitable means for imparting a whirling motion to the column rising from the mixing zone to the vaporizing and mixing chamber.

In a preferred form of the apparatus of the invention, the vaporizing and mixing chamber is juxtaposed on an intermediate chamber open to ambient gaseous component and separated therefrom by a gaseous-component metering means for metering the flow of ambient gaseous component into the vaporizing and mixing chamber; in which the intermediate chamber communicates with the vortex through the fourth aspirating means and, in turn, is juxtaposed on a holding chamber for holding the liquid component and separated therefrom by a common, transverse, impervious wall; in which the holding chamber comprises a liquid-component metering means for metering the flow of liquid component to the vortex; in which the metering means are connected with each other as a direct function so that, when the flow through one is increased, the flow through the other is proportionately increased, and vice versa, and, at the same time, the flows of gaseous component to the vaporizing and mixing chamber and the flow of gaseous and liquid components to the vortex are proportional to the differential in pressure between the vaporizing and mixing chamber and the intermediate chamber so that, when the differential increases, the flows of gaseous components increase concommitantly with a proportional increase in flow of liquid component to the vortex, and vice versa; and, in which adjustable restricting means is provided to adjust the amount of gaseous component aspirated to the vortex relative to the amount thereof aspirated into the vaporizing and mixing chamber.

If desired, a throttling valve can be included in the intake to the intermediate chamber to restrict the flow of ambient gaseous component thereinto. This is effective to reduce the pressure in the intermediate chamber and to reduce the pressure differential between it and the vaporizing and mixing chamber. The metering means operate to restrict flow of the gaseous component from the intermediate chamber into the vaporizing and mixing chamber and the flow of liquid component from the holding chamber.

Suitable means, not shown, is provided for feeding liquid component to the holding chamber and for venting it to the ambient atmosphere, so that the fuel can be aspirated therefrom by subambient pressure in the vaporizing and mixing chamber.

Advantageously, a tubular member extends axially from the holding chamber through the intermediate chamber into the vaporizing and mixing chamber and has a restrictive jet orifice in the middle portion through which a jet of liquid component is aspirated, and a plurality of jet orifices of restricted diameter directed downwardly at an acute, oblique angle from the intermediate chamber to the liquid component jet orifice, with the oblique angle being such that the discharge ends of the gaseous component jet orifices are offset from the vertical axis and terminate in an annular loci, so that there is established a transverse component in each jet which induces a circumferential whirling or swirling motion and an axial component which induces a radial rolling motion, which combine to provide a turbulent vortex, so that the liquid component is quickly dispersed in the gaseous component in the vortex and the mixture aspirated up the tubular member in turbulent whirling flow. The circumferential whirling component of the vortex can be augmented or countered by establishing additional whirling motion further up the tubular member. It also can be augmented or countered by imparting a whirling motion of the liquid component jetted into the vortex. The latter can be accomplished effectively by means of a metering pin having helical grooves therein of increasing cross-sectional area toward the upstream end, so that, the farther the pin is inserted into the tubular member, the greater is the flow of liquid component, and vice versa. It will be understood, of course, that for this purpose, the tubular member is provided with a restricted throat which closely conforms to the pin so that, in the down position of the pin, the flow of liquid component is cut off, whereas, in the up position, the flow of liquid component is along the helical grooves, and increases the farther up the pin is positioned.

In a standard form of the invention, as in the prior art, a tapered pin is used to effect the metering of the liquid component.

The desired turbulent vortex involving a combination of a circumferential motion impressed on a radial rolling motion is most effectively obtained when the acute angle is between about 20 degrees and about 35 degrees, and the oblique angle is between about ten degrees and about 25 degrees; advantageously, about 27 degrees and about 17 degrees, respectively.

BRIEF DESCRIPTION OF THE DRAWINGS

In the drawings:

FIG. 3 is a detailed view of FIG. 1;

FIG. 4 is a detailed view of FIG. 3;

FIG. 5 is a detailed view of a modified form of FIG. 3;

FIG. 6 is a detailed view of a modified form of FIG. 3;

FIG. 7 is a plan view of FIG. 6;

FIG. 8 is a cross-section taken along line VIII—VIII of FIG. 6;

FIG. 9 is a detailed view of a modified form of FIG. 3;

FIG. 10 is a detailed view of a modified form of FIG. 3;

FIG. 11 is a detailed view of a modified form of FIG. 3;

FIG. 12 is a detailed view of a modified form of FIG. 7; and

FIG. 13 is a detailed view of a modified form of FIG. 7.

DETAILED DESCRIPTION OF THE INVENTION

Figures 1, 2:
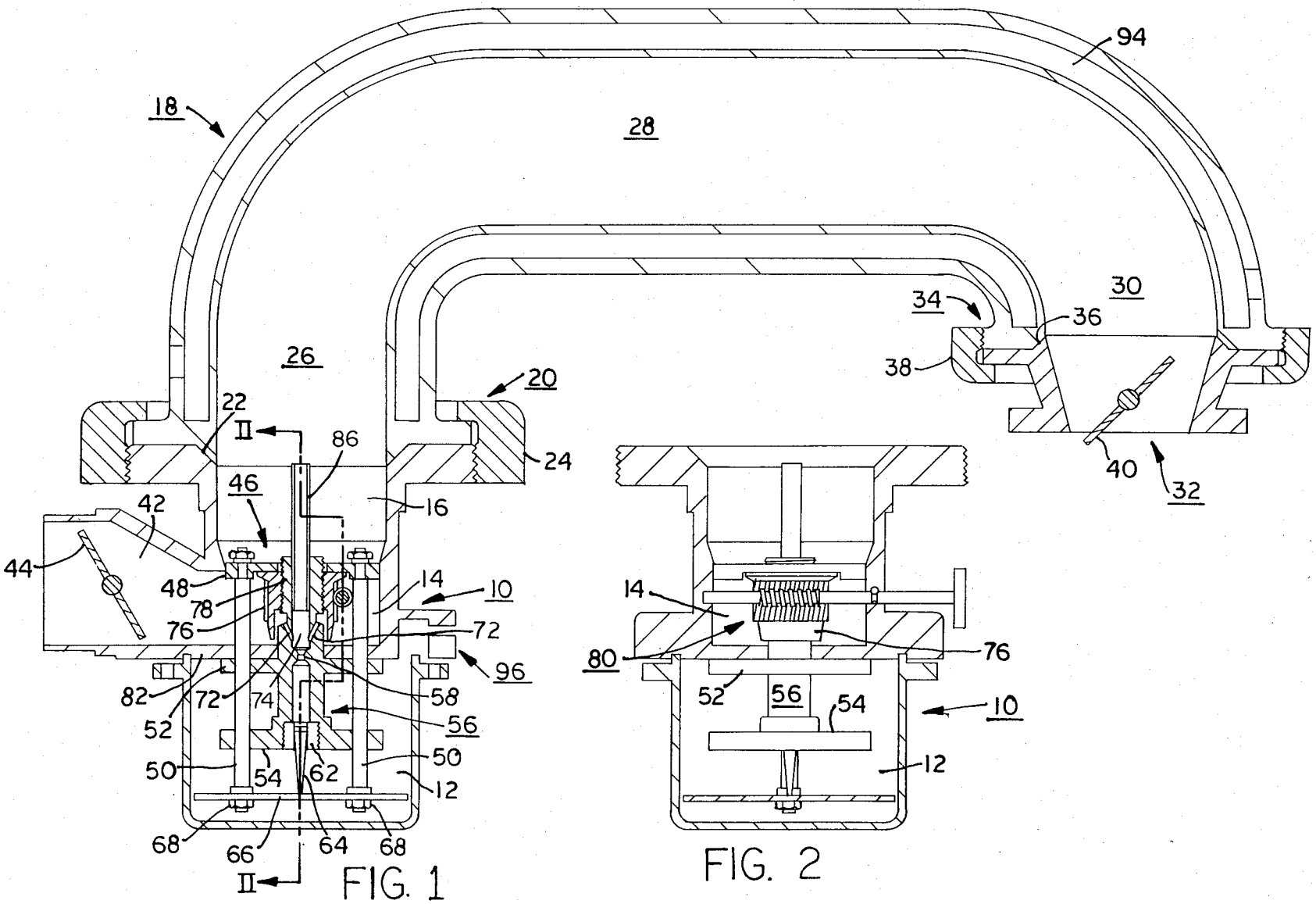
FIG. 1 is a side elevation in section.
FIG. 2 is a sectional view taken along line II—II of FIG. 1.

Referring now to FIGS. 1 and 2, there is shown an up-draft carburetor having a fuel holding bowl or chamber 12 and an intermediate chamber 14 and a vaporizing and mixing chamber 16. While some mixing takes place in the vaporizing and mixing chamber, its primary purpose is to effect vaporization of the liquid fuel aspirated into it. Accordingly, hereinafter chamber 16 will be referred to simply as a vaporizing chamber.

The vaporizing and mixing chamber 16 is connected to conduit 18 by means of a swivel joint 20 having complementary chamfers at 22 and a retaining ring 24.

The conduit 18 has a riser section 26, a horizontal section 28, and a down comer section 30. The latter is connected to an adapter 32 by swivel joint 34.

The adapter 32 is constructed to fit on the carburetor outlet on the manifold of an internal combustion engine, not shown. If desired, it may have a butterfly valve 40 to throttle the flow into the manifold.

Conduit 18, particularly the riser section 26 forms part of the vaporizing and mixing chamber 16. The intermediate chamber 14 and the intake port 42 open into the ambient atmosphere through suitable air filters, and the like, not shown. If desired, a butterfly valve 44 may be provided to regulate the amount of air admitted to the intermediate chamber 14.

The intermediate chamber 14 is separated from the vaporizing chamber 16 by an annular opening 46 which is normally closed by an annular metering valve 48. The annular metering valve 48 is fastened to and supported on vertical rods 50 which are mounted for vertical reciprocation in the support and guide members 52 and 54. Thus, when a condition of subambient pressure exists in conduit 18, as a result of the demand by the engine, the metering valve 48 is raised to allow passage of air from the intermediate chamber 14 into the vaporizing chamber 16. The air passes up around the outside of the valve 48 and also up through the center opening thereof in increasing amounts as the valve is raised.

The fuel from the holding chamber 12 passes up through a vertical tube member 56 having in the midportion thereof a restricted orifice 58. The support or guide members 52 and 54 are affixed to tube 56 as a unitary or integral part thereof and, in turn, the unit is affixed to the common wall 82 between the holding chamber 12 and the intermediate chamber 14. Ordinarily, the restricted orifice 58 is located in the vicinity of the common wall and functions as a venturi throat between the bottom portion of the tube 56 and the portion 74 thereof which functions as a tubular mixing chamber.

The restricted orifice 58 may have diverse shapes, as shown at 58*a*, 58*b*, 58*c*, and 58*d* in FIGS. 3, 9, 10, and 11 in order to accommodate the demands of the particular engine involved. Advantageously, the jet orifices are replaceable as shown at 60 in FIGS. 3 and 9, so that the size of the orifice can be adjusted to adjust the performance of the particular engine involved.

The bottom of the tube 56 has a restricted throat 62 of slightly smaller diameter than the diameter of the tube 56. This throat cooperates with a tapered pin 64 in the shape of an inverted cone with the apex affixed to a transverse member 66, fastened as shown at 68, to the rods 50. At the top of the pin 64 or, at the base of the cone, is a cylindrical portion 70 which fits the restricted throat 62 and prevents the flow of fuel into the tubular member 56. When, however, the pin is raised to the position shown in FIG. 4, for example, as a result of the valve 48 having been raised by the demand of the engine, fuel is admitted between the tapered pin 64 and the throat 62 in proportion to the amount that the pin is raised. Thus, the more air that is aspirated into the vaporizing chamber 16, the more fuel will be aspirated into the tubular member 56, and vice versa.

A portion of the air required for combustion is premixed with the fuel aspirated up to the jet orifice 58. The air required for this purpose is aspirated from the intermediate chamber into the mixing chamber 74 through jet orifices 72. These jet orifices 72 form a cummunication between the mixing chamber 74 and the intermediate chamber 14, so that, on demand of the engine, part of the air is aspirated into the vaporizing chamber 16, through the annular port 46 and the balance is aspirated into the mixing chamber 74 where it mixes with the fuel aspirated through jet orifice 58.

An annular skirt valve 76 separates the jet orifices 72 from the air in the intermediate chamber 14. The shirt valve 76 is threaded onto the tubular member 56, as shown at 78, and can be rotated thereon by the worm gear combination 80 to increase or decrease the space between the skirt valve 76 and the common wall 82 between the chamber 12 and the chamber 14. It also raises or lowers the metering valves 48 and 64. Thus, adjusting the skirt valve 76 up or down, affects the idling speed and the relative flow of air into the vaporizing chamber 16 and the jet orifices 72.

The jet orifices 72 are bored into the tubular member 56 on an acute, oblique angle. The angles are acute in that their projection on a vertical plane through the vertical axis of the tubular member 56, as shown in FIGS. 3 and 6, shows an acute angle; whereas, the projection on a horizontal plane, as shown in FIG. 8, gives an oblique angle. The two combine to bring the orifices to an annular loci, as shown in FIG. 8, so that the horizontal or circumferential component causes the air to whirl in the tubular mixing chamber 74 in a circumferential manner, whereas, the vertical or radial component causes the air to roll in a radial or toroidal fashion and the two together combine to provide a turbulent vortex, into the eye of which the fuel is jetted through the jet orifice 58.

The acute angle, advantageously, is between about 20 degrees and about 35 degrees and the oblique angle is between about 10 degrees and about 25 degrees. Preferably, the angle should be adjusted to give a radial or toroidal roll such that the flow is up, over, and down through the center, so that the flow at the innerface between the air and the fuel is countercurrent. It is to be understood, however, that while this is the most likely condition existing in the vortex, applicants do not desire to be bound by any particular theory, as it is sufficient to obtain the excellent and thorough mixing desired by aspirating the air downwardly through jets at an acute, oblique angle to the vertical, especially with the particular projections specified above.

It is sometimes desirable to impart a whirling motion to the liquid fuel in the bottom portion of the tubular member 56. This is accomplished effectively by the mechanism shown in FIG. 5, where the metering pin 64*a* has essentially the same diameter as the inner diameter of the restricted throat 62 and is provided with a smooth, cylindrical portion 70*a* which acts to stop the flow of fluid and helical grooves 84. The helical grooves 84 have a gradient from shallow near the top to deep or wide near the bottom, so that the flow through increases as the pin is inserted into the tubular member 56 and, the farther the pin is inserted, the greater will be the flow of fuel. Preferably, the helices are such as to cause the fuel to flow in the opposite direction to the circumferential component of the vortex. This brings about an abrupt reversal of direction or a shear when the jet of fuel enters the vortex.

An aspirating tube 86 is inserted in the upper end of tubular member 56 down to the top of the mixing chamber 74. The mixture produced in the mixing chamber is aspirated up through this tube into the vaporizing chamber. Since the tube 86 is inserted in the tubular member 56, as best seen in FIGS. 1 and 3, it has a smaller cross-section than that of the mixing chamber 74. Hence, the flow of the resultant mixture will be faster in the aspirating tube 86, and in the modified forms thereof, than in the mixing chamber 74. The reduction in the cross-section of the column in passing from the mixing chamber 74 into the aspirating tube 86 causes an increase in the axial velocity of the mixture. This effect is enhanced in the modifications shown in FIGS. 6, 7, 12, and 13, where the cross-section is still further reduced. In the modification shown in FIGS. 1 and 3, a still further beneficial effect is obtained because in an open tube in which the circumferential flow is unimpeded, an increase in the circumferential velocity also results from the reduced diameter, much as an increase in the rate of spin of a skater results when his extended arms are drawn in.

As shown in FIGS. 6, 7, 12, and 13 it is sometimes desirable to impart a whirl to the upward flowing mixture which, advantageously, is counter to the direction of the flow of the circumferential component of the vortex. By replacing the aspirating tube 86 by a plurality of smaller tubes 88 with the proper twist, the desired whirling motion will be imparted to the column of resultant mixture so that it flies out by centrifugal force when it reaches the vaporizing and mixing chamber. The interstices between the tubes 88 may, if desired, be filled, so that all of the gas-fuel mixture will have to go to the end of the tubes 88. If desired, twisted tubes **88*a* can be inserted in the tube 86, so that the flow of the mixture of air and fuel will be both in the tubes 88*a* and the interstices 90*a*. If desired, a twisted, star-shaped insert 92 can be inserted in the tube 86**.

If desired, the tube 18 can be jacketed, as shown at 94, so that a heat-exchange fluid, such as cooling water or cooling oil, can be utilized to heat the fuel-gas mixture in its passage to the manifold.

Fuel inlet openings 96 are pvovided for the purpose of admitting fuel thereto and/or for maintaining it at ambient pressure. The fuel level can be float-controlled, if desired, by a float-controlled needle valve and as shown in detail in U.S. Pat. No. 2,715,020, issued Aug. 9, 1955, and the holding chamber vented to the ambient by a vent above the liquid level. Details for this purpose are well known in the art and are not further illustrated herein.

In operation of the device, when a demand is placed on the carburetor by the engine, it is manifested by subambient pressure in the conduit 18 which causes the annular valve 48 to be lifted, allowing ambient air to flow into the vaporizing and mixing chamber 16. At the same time, the metering pin 64 is raised, allowing fuel to flow into the tubular member 56. Simultaneaously, air is aspirated through the jet orifices 72 to an annular loci at the bottom of the mixing chamber 74 of the tubular member 56, thereby creating a turbulent vortex into the eye of which the fuel is aspirated through the jet orifice 58. The fuel is thus disrupted into fine globules and dispersed in the portion of the air admitted through jet ports 72 and the resulting mixture, which is whirling at a great rate, moves upwardly through aspirating tube 86 into the vaporizing chamber 16. This whirling motion may be augmented or replaced by the whirling motion in the opposite direction by the whirl-inducing means discussed above and, however induced, the whirling column flies out by centrifugal force into the vaporizing chamber 16. This causes a further breakup of the globules of fuel and final vaporization thereof in such an intimate dispersion that the mixture of gas and fuel fed to the engine has uniform distribution of molecules of air and fuel. The effect is enhanced when, as shown in FIG. 3, the aspirating tube 86 has a smaller cross-section than that of the tubular mixing chamber 74. The result is a greater economy of fuel, less sensitivity to dirt in the fuel, and sticky needle valves, and the like. Moreover, all of these advantages are obtained without moving parts, other than the metering and throttling valves.

While we have described this invention with reference to a particular manner of obtaining a whirling vortex in the mixing zone, it is to be understood that in the broader aspects of the invention, the type of mixing zone of the prior art can be utilized with the modification of FIGS. 5 and 6.

It is to be understood that the invention is not to be limited to the exact details of operation or structure shown and described, as obvious modifications and equivalents will be apparent to one skilled in the art.

We claim:

1. In a process for effecting carburetion of a gaseous component and a volatile liquid component of a reaction mixture which needs to be in a gaseous condition prior to the initiation of the reaction, which comprises, aspirating a portion of said gaseous component into a vaporizing chamber maintained at subambient pressure, mixing the remaining portion of said gaseous component with said liquid component in a cylindrical mixing chamber having a discharge end coaxial with a tubular aspirating extension which opens into said vaporizing chamber and an inlet end at the opposite end thereof; and aspirating the resultant mixture into said vaporizing chamber and allowing it to disperse therein; the improvement which comprises, effecting said mixing by aspirating a jet of said liquid component axially into said cylindrical mixing chamber through an axial liquid component jet orifice in the inlet end thereof; aspirating a plurality of jets of said gaseous component into said mixing chamber through gaseous component jet orifices located in the periphery thereof, oriented at an acute, oblique angle which impresses a circumferential whirling motion on a radial motion in which the incoming gaseous component meets the incoming liquid component head-on in a turbulent, rolling, toroidal vortex, thereby producing a mixture comprising an intimate dispersion of the liquid component in the gaseous component which rapidly vaporizes after it passes out of said tubular aspirating extension and flies out radially as a result of centrifugal force into said vaporizing chamber.

2. A process of claim 1, in which a circumferential motion is impressed on the resultant mixture in said aspirating tube which is countercurrent to the circumferential whirling component of said vortex.

3. A process of claim 2, in which a whirling motion is imparted to said jet of liquid component before it enters the eye of said vortex.

4. A process of claim 3, in which the whirling motion imparted to said jet of liquid component is countercurrent to the circumferential whirling component of said vortex.

5. A process of claim 1 in which a whirling motion is imparted to said jet of liquid component before it is jetted into said mixing chamber.

6. A process of claim 5, in which a whirling motion is imparted to the mixture formed in said mixing chamber which is countercurrent to the whirling motion imparted to the jet of liquid component.

7. A process of claim 1, in which a second whirling motion is impressed on the resultant mixture while it is in said aspirating tube.

8. A process of claim 7, in which said second whirling motion is counter to said circumferential whirling motion.

9. A process of claim 1, in which said acute angle is between about 20 and about 35 degrees and said oblique angle is between about 10 and about 25 degrees, so that the radial rolling motion is inward and then down axially into the incoming jet of liquid component.

10. A process of claim 9 in which the acute angle is about 27 degrees and the oblique angle is about 17 degrees.

11. A process of claim 1, in which said aspirating extension has a cross-section smaller than that of said mixing chamber, whereby the axial velocity of the resultant mixture of liquid and gaseous components is increased as it passes from said mixing chamber into said aspirating extension.

12. A process of claim 11, in which said tubular extension is an open tube in which the circumferential flow is unimpeded, whereby an increase in the circumferential velocity is obtained along with the increase in the axial velocity.

13. In apparatus for effecting carburetion of a gaseous component and a volatile liquid component of a reaction mixture which needs to be in a gaseous condition prior to the initiation of the reaction, which comprises, first aspirating means for aspirating a portion of said gaseous component into a vaporizing chamber adapted to be maintained at subambient pressure; mixing means for mixing the remaining portion of said gaseous component with said liquid component in such a manner that the liquid component is dispersed in the liquid phase in said gaseous component; and second aspirating means for aspirating the gaseous component and the liquid component into said mixing means and aspirating the resultant mixture into said vaporizing chamber and allowing it to disperse therein; said mixing means comprising a tubular mixing chamber having a discharge end, an axial, liquid component jet orifice at the opposite end thereof, and circumferential gaseous component jets, and said second aspirating means comprising a tubular extension coaxial with said mixing chamber and having one end communicating with the discharge end thereof and the opposite end communicating with said vaporizing chamber; the improvement which further comprises whirl-inducing means for inducing a whirling motion in said mixing chamber and in which said tubular extension is an open tube in which the circumferential flow is unimpeded and has a cross-section smaller than that of said mixing chamber, whereby both the axial and circumferential velocity of the resultant whirl is increased as it passes from said mixing chamber into said tubular extension.

14. In a process for effecting carburetion of a gaseous component and a volatile liquid component of a reaction mixture which needs to be in a gaseous condition prior to the initiation of the reaction, which comprises, aspirating a portion of said gaseous component into a vaporizing chamber maintained at subambient pressure, mixing the remaining portion of said gaseous component with said liquid component in a cylindrical mixing chamber having a discharge end coaxial with a tubular aspirating extension which opens into said vaporizing chamber and an inlet end at the opposite end thereof, said mixing being effected by aspirating a jet of liquid component through said inlet end axially into said mixing chamber and concomitantly aspirating jets of gaseous component into said mixing chamber; the improvement which further comprises whirl-inducing means for inducing a whirling motion in said mixing chamber and in which said tubular extension is an open tube in which the circumferential flow is unimpeded and has a cross-section smaller than that of said mixing chamber, whereby both the axial and circumferential velocity of the resultant whirl is increased as it passes from said mixing chamber into said tubular extension.

15. Apparatus of claim 14, which further comprises whirl-inducing means for inducing a whirling motion in the jet of liquid component jetted into said mixing chamber through said axial, liquid component jet.

16. Apparatus of claim 15, which further comprises means for imparting a whirling motion to the mixture produced in said mixing chamber which is counter to the whirling motion induced by said whirl-inducing means.

17. Apparatus of claim 15, in which said whirl-inducing means comprises a metering pin which governs the flow of liquid component to said liquid component jet orifice, has helical grooves therein of increasing cross-sectional area toward the bottom of said pin, and is so disposed in a tubular member that the farther the pin is inserted into said tubular passageway, the greater is the flow of liquid component to said liquid component jet orifice, and vice versa.

18. In apparatus for effecting carburetion of a gaseous component and a volatile liquid component of a reaction mixture which needs to be in a gaseous condition prior to the initiation of the reaction, which comprises, first aspirating means for aspirating a portion of said gaseous component into a vaporizing chamber adapted to be maintained at subambient pressure; mixing means for mixing the remaining portion of said gaseous component with said liquid component in such a manner that the liquid component is dispersed in the liquid phase in said gaseous component; and second aspirating means for aspirating the gaseous component and the liquid component into said mixing means and aspirating the resultant mixture into said vaporizing chamber and allowing it to disperse therein; said mixing means comprising a tubular mixing chamber having a discharge end, an axial, liquid component jet orifice at the opposite end thereof, and circumferential gaseous component jets, and said second aspirating means comprising a tubular extension coaxial with said mixing chamber and having one end communicating with the discharge end thereof and the opposite end communicating with said mixing chamber; the improvement in which said mixing chamber comprises circumferentially-disposed, gaseous component jet orifices through which a plurality of jets of said gaseous component are aspirated into said mixing chamber, said gaseous component jet orifices being oriented to deliver said jets at a acute, oblique angle which impresses a circumferential whirling motion on a radial motion in which the incoming gaseous component meets the incoming liquid component head-on in a turbulent, rolling, torodial vortex, thereby producing a mixture comprising an intimate dispersion of the liquid component in the gaseous component which rapidly vaporizes after it passes out of said tubular aspirating extension and flies out radially as a result of centrifugal force into said vaporizing chamber, thereby creating a turbulence which promotes mixing and vaporizing therein; the aspirating of said gaseous and liquid components being induced by a state of subambient pressure in said vaporizing chamber.

19. Apparatus of claim 18, in which means independent of the means which produces said vortex impresses a circumferential motion on said vortex which is countercurrent to the circumferential whirling component of said vortex.

20. Apparatus of claim 19, which further comprises whirl inducing means for inducing a whirling motion in said jet of liquid component before it enters the eye of said vortex.

21. Apparatus of claim 20, in which said whirl inducing means produces a whirling motion countercurrent to the circumferential whirling component of said vortex.

22. Apparatus of claim 18, in which said acute angle is between about 20 and about 35 degrees and said oblique angle is between about 10 and about 25 degrees, so that the radial rolling motion is inward and the incoming jet of liquid component.

23. Apparatus of claim 22, in which the acute angle is about 27 degrees and the oblique angle is about 17 degrees.

24. An apparatus of claim 18, in which said aspirating extension has a cross-section smaller than that of said mixing chamber, whereby the axial velocity of the resultant mixing of liquid and gaseous components is increased as it passes from said mixing chamber into said aspirating extension.

25. An apparatus of claim 24, in which said tubular extension is an open tube in which the circumferential flow is unimpeded, whereby an increase in the circumferential velocity is obtained along with the increase in the axial velocity.

26. Apparatus of claim 18, in which said vaporizing chamber is juxtaposed on an intermediate chamber open to ambient gaseous component and separated therefrom by a gaseous-component metering means for metering the flow of ambient gaseous component into said vaporizing chamber; in which said intermediate chamber communicates with said mixing chamber through said gaseous component jet orifices and is juxtaposed on a holding chamber and separated therefrom by a common, transverse, impervious wall; in which said holding chamber comprises a liquid-component metering means for metering the flow of liquid component to said mixing chamber; in which said metering means are connected with each other as a direct function so that, when the flow through one is increased, the flow through the other is proportionately increased, and vice versa, and, at the same time, the flows of gaseous component to said vaporizing chamber and the flow of gaseous and liquid components to said mixing chamber are proportional to the differential in pressure between said vaporizing chamber and said intermediate chamber, so that, when the differential increases, the flow of gaseous components increase concommitantly with a proportional increase the flow of liquid component to said mixing chamber, and vice versa; and, in which adjustable restricting means is provided to adjust the amount of gaseous component aspirated into said mixing chamber relative to the amount thereof aspirated into said vaporizing chamber.

27. Apparatus of claim 26, which further comprises a tubular passageway which comprises said mixing chamber and said aspirating extension and extends axially from said holding chamber through said intermediate chamber into said vaporizing chamber, in which said liquid component jet orifice forms a venturi-like throat in said tubular passageway; in which said gaseous component jet orifices are directed at an acute, oblique angle from said intermediate chamber to said mixing chamber, said oblique angle being such that the discharge ends of said liquid component jet orifices are offset from the axis and terminate in an annular loci, whereby the transverse components of the jets induce a circumferential whirling motion and the acute angle being such that the axial components induced thereby cause a radial rolling motion which combines with the circumferential whirling motion to provide such a turbulent vortex that the liquid component is quickly dispersed in the gaseous component in the vortex and the resultant mixture is aspirated up said aspirating extension in turbulent, whirling flow.

28. Apparatus of claim 27, in which the aspirating extension portion of said tubular passageway is provided with whirl inducing means separate from the vortex-establishing means which induces a further whirling motion in said resultant mixture as it flows in said tubular member.

29. Apparatus of claim 28, in which said means for inducing a whirling motion in the downstream portion of said tubular passageway produces a whirling motion which is counter to that induced in said vortex.

30. Apparatus of claim 29, in which the aspirating extension portion of said tubular passageway is provided with means for inducing a whirling motion in the liquid component aspirated to said vortex.

31. Apparatus of claim 30, in which the direction of the whirling motion induced in said liquid component is counter to that induced in said vortex.

32. Apparatus of claim 26, which further comprises whirl-inducing means for inducing a whirling motion in the liquid component aspirated into said vortex.

33. Apparatus of claim 32, in which the direction of the whirling motion induced in said liquid component is counter to that induced in said vortex.

34. Apparatus of claim 32, in which the means for inducing a whirling motion in said liquid component is comprised in said liquid-component metering means and comprises a metering pin having helical groove therein of increasing cross-sectional area toward the bottom of said pin, so that the farther the pin is inserted into said tubular passageway, the greater is the flow of liquid component, and vice versa.

* * * * *

UNITED STATES PATENT AND TRADEMARK OFFICE

CERTIFICATE OF CORRECTION

PATENT NO. : 4,504,425

DATED : March 12, 1985

INVENTOR(S) : Darnell T. Dudley and Herman F. Luhrs

It is certified that error appears in the above-identified patent and that said Letters Patent is hereby corrected as shown below:

Title page, [57] ABSTRACT, lines 5 & 6; "justaposed" should read -- juxtaposed -- both instances
Col. 1, line 28; "cumbustion" should read -- combustion --
Col. 2, line 8; "centrifigual" should read -- centrifugal --
Col. 6, line 13; "cummunication" should read -- communication --
Col. 6, line 20; "shirt" should read -- skirt --
Col. 7, line 65; "Simultaneaously" should read -- Simultaneously --
Col. 9, line 40; "In" should read -- An --
Col. 10, line 44; "In" should read -- An --
Col. 10, line 26; "claim 14" should read -- claim 18 --
Col. 11, line 3; "a" should read -- an --
Col. 11, lines 23 & 26; "whirl inducing" should read -- whirl-inducing -- in both instances.
Col. 12, line 36; "whirl inducing" should read -- whirl-inducing --
Col. 12, line 60; "groove" should read -- grooves --

Signed and Sealed this

*Eleventh* Day of *February 1986*

[SEAL]

*Attest:*

DONALD J. QUIGG

*Attesting Officer*

*Commissioner of Patents and Trademarks*